US007261683B2

(12) United States Patent
Carr

(10) Patent No.: US 7,261,683 B2
(45) Date of Patent: Aug. 28, 2007

(54) CONICAL PISTON SOLIDS DISCHARGE AND PUMPING CENTRIFUGAL SEPARATOR

(75) Inventor: Robert B. Carr, Sharon, MA (US)

(73) Assignee: Wagner Development, Inc. (MC)

( * ) Notice: Subject to any disclaimer, the term of this patent is extended or adjusted under 35 U.S.C. 154(b) by 528 days.

(21) Appl. No.: 10/973,949

(22) Filed: Oct. 26, 2004

(65) Prior Publication Data

US 2005/0233883 A1 Oct. 20, 2005

Related U.S. Application Data

(63) Continuation-in-part of application No. 10/823,844, filed on Apr. 14, 2004, now Pat. No. 7,052,451.

(51) Int. Cl.
*B04B 11/05* (2006.01)
*B04B 11/08* (2006.01)

(52) U.S. Cl. ..... 494/50; 494/56; 494/65; 210/376

(58) Field of Classification Search ..... 494/46, 494/50–52, 55–59, 62, 65, 67, 83, 84; 210/372–377; 251/211–212, 298–300, 324–325
See application file for complete search history.

(56) References Cited

U.S. PATENT DOCUMENTS 1,909,188 A 5/1933 Roberts
2,040,351 A 5/1936 Williams
2,094,058 A 9/1937 Bryson (Continued)

FOREIGN PATENT DOCUMENTS

CH 604 906 9/1978

(Continued)

OTHER PUBLICATIONS

Carr Powerfuge Brochure, Carr Separations, Inc., undated, p. 1-4.

(Continued)

*Primary Examiner*—Charles E. Cooley
(74) *Attorney, Agent, or Firm*—Weingarten, Schurgin, Gagnebin & Lebovici LLP

(57) ABSTRACT

A centrifugal separator includes a cylindrical bowl having a conical lower end with an opening through which feed liquid is injected during a feed mode of operation. The feed liquid is separated into centrate and solids, which accumulate along the inner surface of the bowl. A piston assembly includes a conical piston disposed within the cylindrical bowl, coupled to a piston actuator by a two-part piston shaft. During the feed mode of operation, the piston shaft is disconnected, and the piston is held in an uppermost position by hydraulic pressure from the feed liquid as the bowl is rotated, and a centrate valve on the piston is opened to permit the centrate to flow out to a centrate discharge port. After solids are separated and accumulated on an interior surface of the bowl, the rotation of the bowl is stopped and residual centrate is drained therefrom. In a solids discharge and pumping mode of operation, the piston shaft is connected and the piston actuator urges the piston axially downward, closing the centrate valve and forcing the accumulated solids from the bowl via the opening in the conical lower end of the bowl and into a passage leading to a solids outlet port.

50 Claims, 11 Drawing Sheets

U.S. PATENT DOCUMENTS

| | | | | |
|---|---|---|---|---|
| 2,790,309 | A * | 4/1957 | Wenzelberger | 62/342 |
| 3,306,681 | A | 2/1967 | Barringer | |
| 3,403,848 | A | 10/1968 | Windsor et al. | |
| 3,539,096 | A | 11/1970 | Lewis et al. | |
| 3,741,465 | A | 6/1973 | Lincoln | |
| 3,770,191 | A | 11/1973 | Blum | |
| 3,972,514 | A | 8/1976 | Voitsekhovsky et al. | |
| 4,155,503 | A | 5/1979 | Sears | |
| 4,513,566 | A | 5/1979 | Ryer et al. | |
| 4,416,655 | A | 11/1983 | Bennett | |
| 4,493,768 | A | 1/1985 | Kubr et al. | |
| 4,493,769 | A | 1/1985 | Paschedag et al. | |
| 4,687,463 | A | 8/1987 | Simonnet | |
| 4,692,247 | A | 9/1987 | Orlans | |
| 4,875,334 | A | 10/1989 | Rajsigl et al. | |
| 5,250,180 | A | 10/1993 | Chang | |
| 5,328,441 | A | 7/1994 | Carr | |
| 5,356,367 | A | 10/1994 | Carr | |
| 5,425,698 | A | 6/1995 | Carr | |
| 5,454,777 | A | 10/1995 | Ziems et al. | |
| 5,674,174 | A | 10/1997 | Carr | |
| 5,733,238 | A | 3/1998 | Carr | |
| 5,743,840 | A | 4/1998 | Carr | |
| 5,879,279 | A | 3/1999 | Berger et al. | |
| 5,916,082 | A | 6/1999 | Opfer | |
| 6,126,587 | A | 10/2000 | Berger et al. | |
| 6,149,573 | A | 11/2000 | Berger et al. | |
| 6,224,532 | B1 | 5/2001 | Beattey | |
| 6,248,054 | B1 | 6/2001 | Berger et al. | |
| 6,251,056 | B1 | 6/2001 | Berger et al. | |
| 6,461,286 | B1 | 10/2002 | Beattey | |
| 6,478,724 | B1 | 11/2002 | Beattey | |
| 6,632,166 | B2 | 10/2003 | Carr | |
| 6,776,752 | B2 | 8/2004 | Carr | |
| 6,932,757 | B2 | 8/2005 | Beattey | |
| 6,986,734 | B2 * | 1/2006 | Carr | 494/46 |
| 7,052,451 | B2 * | 5/2006 | Carr | 494/50 |
| 2002/0016243 | A1 | 2/2002 | Carr | |
| 2003/0017931 | A1 | 1/2003 | Beattey | |
| 2003/0195105 | A1 | 10/2003 | Carr | |
| 2005/0003945 | A1 | 1/2005 | Beattey | |
| 2005/0009681 | A1 | 1/2005 | Carr | |
| 2005/0043164 | A1 | 2/2005 | Opfer | |
| 2005/0233882 | A1 * | 10/2005 | Carr | 494/50 |
| 2005/0233883 | A1 * | 10/2005 | Carr | 494/50 |
| 2007/0049479 | A1 * | 3/2007 | Carr | 494/23 |

FOREIGN PATENT DOCUMENTS

| | | | |
|---|---|---|---|
| DE | 4002073 | C1 * | 5/1991 |
| EP | 0947252 | A2 * | 10/1999 |
| JP | 63171656 | | 7/1988 |
| JP | 64-70157 | * | 3/1989 |
| JP | 71444150 | | 6/1995 |
| JP | 8131894 | | 5/1996 |
| JP | 8266936 | | 10/1996 |
| JP | 985129 | | 9/1997 |
| JP | 2001-140704 | | 5/2000 |
| JP | 2003-144973 | | 5/2005 |
| WO | WO 00/38762 | | 7/2000 |
| WO | 2006/046141 | A1 * | 5/2006 |

OTHER PUBLICATIONS

Alfa-Laval CHPX Centrifuge Brochure, Alfa Laval, Inc., undated, p. 1.

Shanghai Centrifuge Institute, SCI Tube Bowl Centrifuge, Shanghai, China, undated, p. 1-2.

* cited by examiner

CONICAL PISTON SOLIDS DISCHARGE AND PUMPING CENTRIFUGAL SEPARATOR

CROSS REFERENCE TO RELATED APPLICATIONS

This patent application is a continuation-in-part of U.S. application Ser. No. 10/823,844 filed on Apr. 14, 2004 which issued as U.S. Pat. No. 7,052,451 and is entitled, CONICAL PISTON SOLIDS DISCHARGE CENTRIFUGAL SEPARATOR, the whole of which is hereby incorporated by reference herein.

BACKGROUND OF THE INVENTION

The present invention generally relates to centrifuges and in particular to centrifuges enabling the automatic discharge and pumping of solids that accumulate during separation.

Many different types of centrifugal separators are known for separating heterogeneous mixtures into components based on specific gravity. A heterogeneous mixture, which may also be referred to as feed material or feed liquid, is injected into a rotating bowl of the separator. The bowl rotates at high speeds and forces particles of the mixture, having a higher specific gravity, to separate from the liquid by sedimentation. As a result, a dense solids cake compresses tightly against the surface of the bowl, and the clarified liquid, or "centrate", forms radially inward from the solids cake. The bowl may rotate at speeds sufficient to produce forces 20,000 times greater than gravity to separate the solids from the centrate.

The solids accumulate along the wall of the bowl, and the centrate is drained off. Once it is determined that a desired amount of the solids has been accumulated, the separator is placed in a discharge mode in which the accumulated solids are removed from the separator. In a typical configuration, an internal scraper is engaged to scrape the solids from the walls of the separator bowl.

Prior separators have shortcomings when operating with particular kinds of materials. For example, many separators may not be capable of completely discharging residual solids that are sticky, which can result in poor yield. This can be especially problematic for high-value materials such as are encountered in pharmaceutical processes. Additionally, many separators subject the feed material to very high shear forces when accelerating the feed liquid to the rotational speed of the bowl, which can damage sensitive materials such as pharmaceuticals or biological substances that include intact cells. Other existing separators do not provide a convenient means by which to handle and recover these sensitive materials.

It would be desirable to have a centrifugal separator that can be effectively used with materials of the type described, namely those that result in sticky accumulated solids and those that are sensitive to shear forces generated during the centrifuge process. It would also be useful to have a separator that can easily recover such solids without the possibility of external contamination or additional operator handling.

BRIEF SUMMARY OF THE INVENTION

In accordance with the present invention, a centrifugal separator is disclosed that performs well with sticky solids and that exhibits low-shear acceleration of feed liquid, making the separator particularly useful for sensitive materials such as pharmaceutical and biological materials. The separator is also useful for recovering these sensitive materials without further handling.

The separator includes a cylindrical bowl having a conical lower end with an opening through which feed liquid is injected during a feed mode of operation. As the bowl rotates at a high speed, the injected feed liquid encounters the sloped surface of the conical lower end of the bowl first. Rotational acceleration forces are imparted relatively gradually as the liquid continues its movement radially outward. The feed liquid is ultimately separated into centrate and solids, the solids accumulating along the inner surface of the bowl.

The separator further includes a piston assembly including a conical piston coupled to a piston actuator, with the piston being disposed within the bowl in tight-fitting relationship with the inner surface thereof. In a solids discharge mode of operation, the piston actuator urges the piston axially downward to force the accumulated solids from the bowl via the opening in the conical lower end of the bowl. The conical shape promotes relatively complete discharge of the solids.

In the disclosed separator, the piston is held in an uppermost position during the feed mode of operation by hydraulic pressure from the feed liquid. The piston includes a centrate valve that is urged open during the feed mode of operation to permit the centrate to flow out of the bowl and into a passage leading to a centrate discharge port. As the piston is urged downward during the solids discharge mode of operation, the centrate valve automatically closes, preventing the accumulated solids from passing into the centrate passage.

In another embodiment, the separator includes a divert assembly including a solids divert valve movably located below a rotatable residual divert valve, when the residual divert valve is at the opening in the conical lower end of the bowl. In a solids pumping mode of operation, a residual divert valve actuator rotates the residual divert valve such that the solids divert valve can be urged upward into communication with the opening in the bowl by a solids divert piston. The conical piston is then urged axially downward by its actuator to push or "pump" the accumulated solids from the bowl into a passage leading to a solids outlet port.

The disclosed separator also includes a two-part piston shaft having a connected position and a disconnected position. When the piston shaft is in the disconnected position, the piston is permitted to be forced upwardly and to rotate with the bowl. When the piston shaft is in the connected position, the piston can be pushed and pulled axially by the piston actuator, thus facilitating the solids discharge and pumping modes of operation.

Other aspects, features, and advantages of the present invention will be apparent from the Detailed Description that follows.

DETAILED DESCRIPTION OF THE INVENTION

Figure 1:
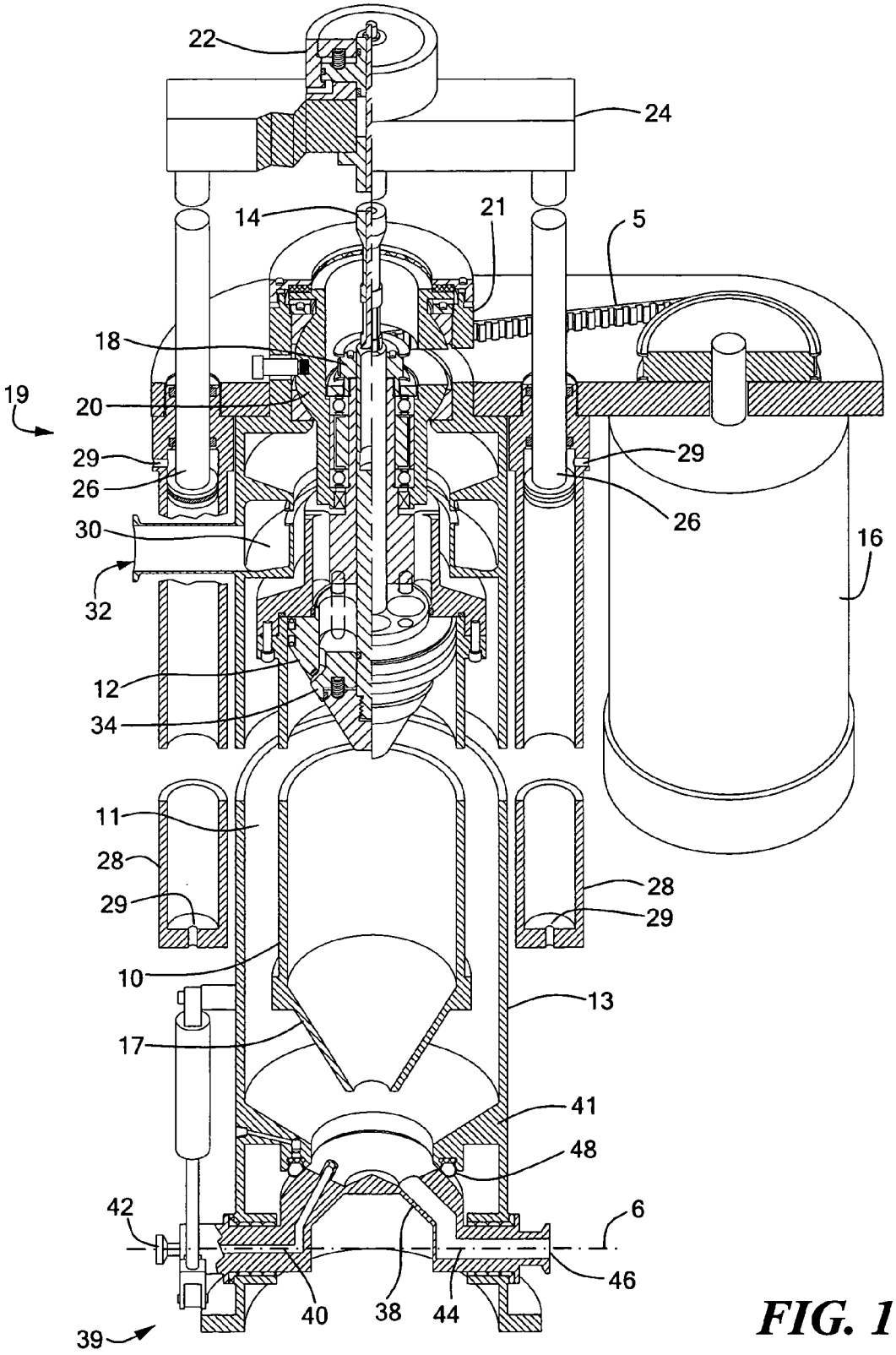
FIG. 1 is a section view of a first embodiment of a centrifuge in accordance with the present invention.

FIG. 1 shows a centrifugal separator in vertical section, with a middle portion removed so as to illustrate a horizontal section as well. The centrifugal separator includes a cylindrical separator bowl 10 mounted in a central region 11 of a separator housing 13. The separator bowl 10 is preferably a cylindrical type bowl having a relatively small diameter D and a length L such that the ratio of L/D is approximately 5/1 or greater. The separator includes a piston assembly consisting of a piston 12 connected to a piston shaft 14. As shown, the piston 12 has a conical shape that matches the shape of a conical feed cone 17 of the bowl 10. The feed cone 17 acts as a rotational accelerator of the feed liquid during a feed mode of operation of the separator.

A variable speed drive motor 16 is connected by a drive belt 5 to a drive pulley 18 of a spherically mounted bearing and spindle assembly 20 located at a collar-like extension 21 of the upper end of the separator housing 13. The drive motor 16 is controllably operated to rotate the separator bowl 10 at desired speeds for separating the feed liquid.

A piston shaft coupling lock cylinder 22 is mounted in a crosshead 24 of a piston actuator which includes two piston actuator plungers 26 mounted in respective piston actuator cylinders 28. Each piston actuator plunger 26 is operatively connected to the piston shaft 14 via the crosshead 24 for raising and lowering the piston 12 within the separator bowl 10 in response to compressed air or hydraulic fluid introduced at piston actuator ports 29. As described in greater detail below, the piston shaft 14 includes two parts that are selectively connected together or disconnected depending on the operating mode, such that the piston 12 is permitted to rotate with the bowl 10 when the parts are disconnected, and can be moved axially within the bowl 10 when the parts are connected.

Also shown in FIG. 1 are a centrate case 30, a centrate outlet port 32 and a centrate valve 34, all of which are involved in removing the centrate, or clarified liquid, from the centrifugal separator during operation, as described in more detail below. A solids valve 38 is mounted in a lower end region 39 of the separator housing 13, below an inward-facing flange 41. The solids valve 38 incorporates both a feed liquid passage 40 in communication with a feed liquid port 42, as well as a residual liquid drain passage 44 in communication with a residual liquid drain port 46. A solids valve seal 48 is disposed on a lower surface of the flange 41. The solids valve 38 is shown in a closed position maintained during the feed mode of operation of the separator. The solids valve 38 can be rotated along axis 6 to an open position such that accumulated solids can be discharged through the lower end of the separator during the solids discharge mode of operation.

Figure 2:
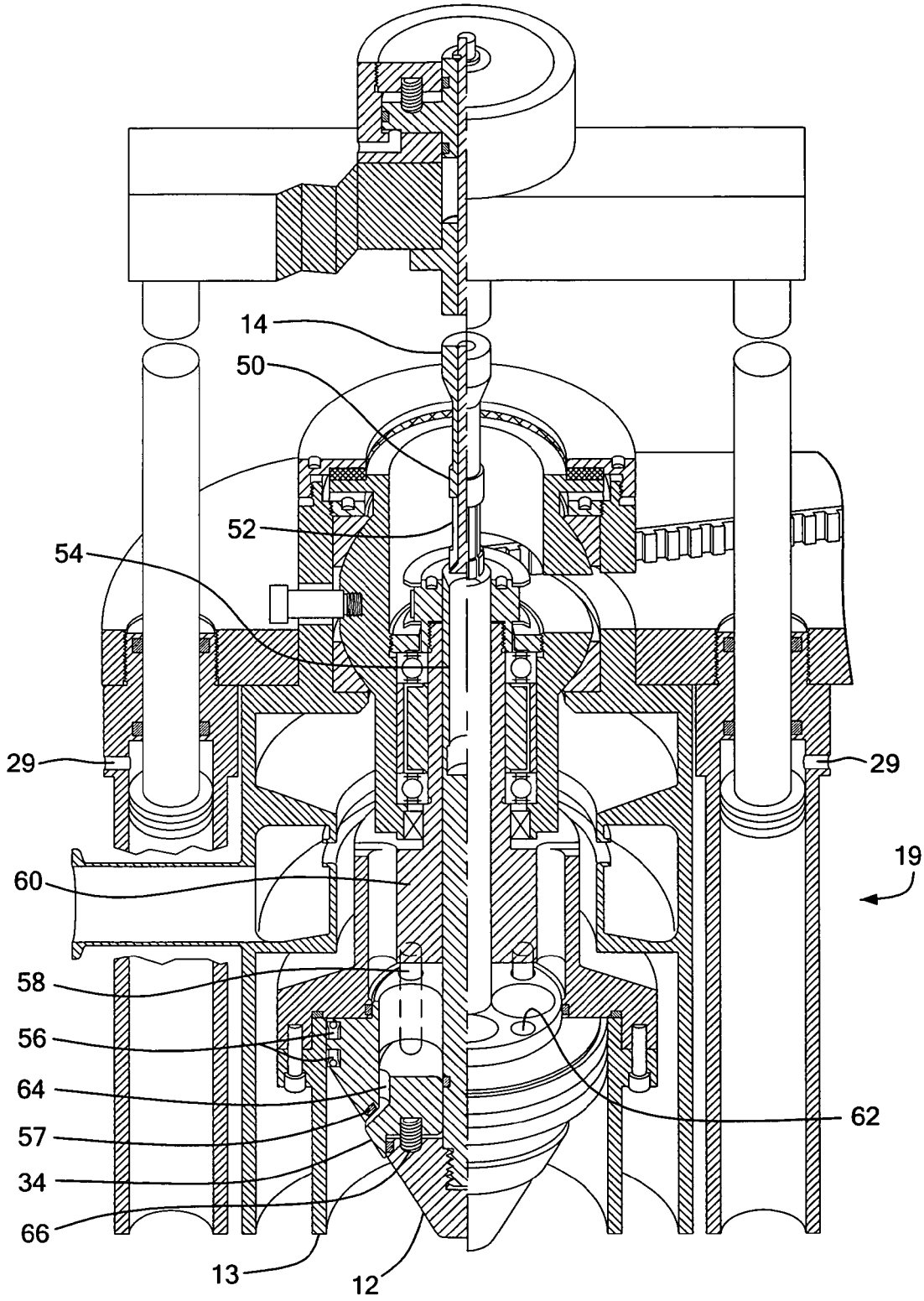
FIG. 2 is a detailed section view of an upper portion of the centrifuge of FIG. 1.

FIG. 2 shows the upper portion 19 of the separator in greater detail. The two-part piston shaft 14 includes an upper piston shaft 50 with a coupling portion 52, and a lower piston shaft 54. The manner in which the upper and lower piston shafts 50 and 54 engage each other is described below. FIG. 2 also shows piston seals 56 that seal the interface between the piston 12 and the inner surface of the bowl 13. The seals 56 are of the type commonly referred to as O-ring loaded lip seals, and are made of a TEFLON-containing (E. I. du Pont de Nemours and Company, 1007 Market Street, Wilmington, Del. 19898) elastomeric material. Centrate seals 57 of similar construction seal the interface between the centrate valve 34 and the upper part of the piston 12 when the centrate valve 34 is closed.

In FIG. 2, the centrate valve 34 is shown in the open position, which results from the downward pushing action of pins 58 extending from a hub 60 through openings 62 in the upper part of the piston 12. With the centrate valve 34 in this open position, centrate can flow through small grooves 64. The centrate valve 34 is open only when the piston 12 is at its uppermost position against the hub 60. As the piston is pushed downward away from the pins 58 by the piston actuator, springs 66 urge the centrate valve slightly upward to a closed position, which is maintained throughout the solids discharge process.

Figure 3:
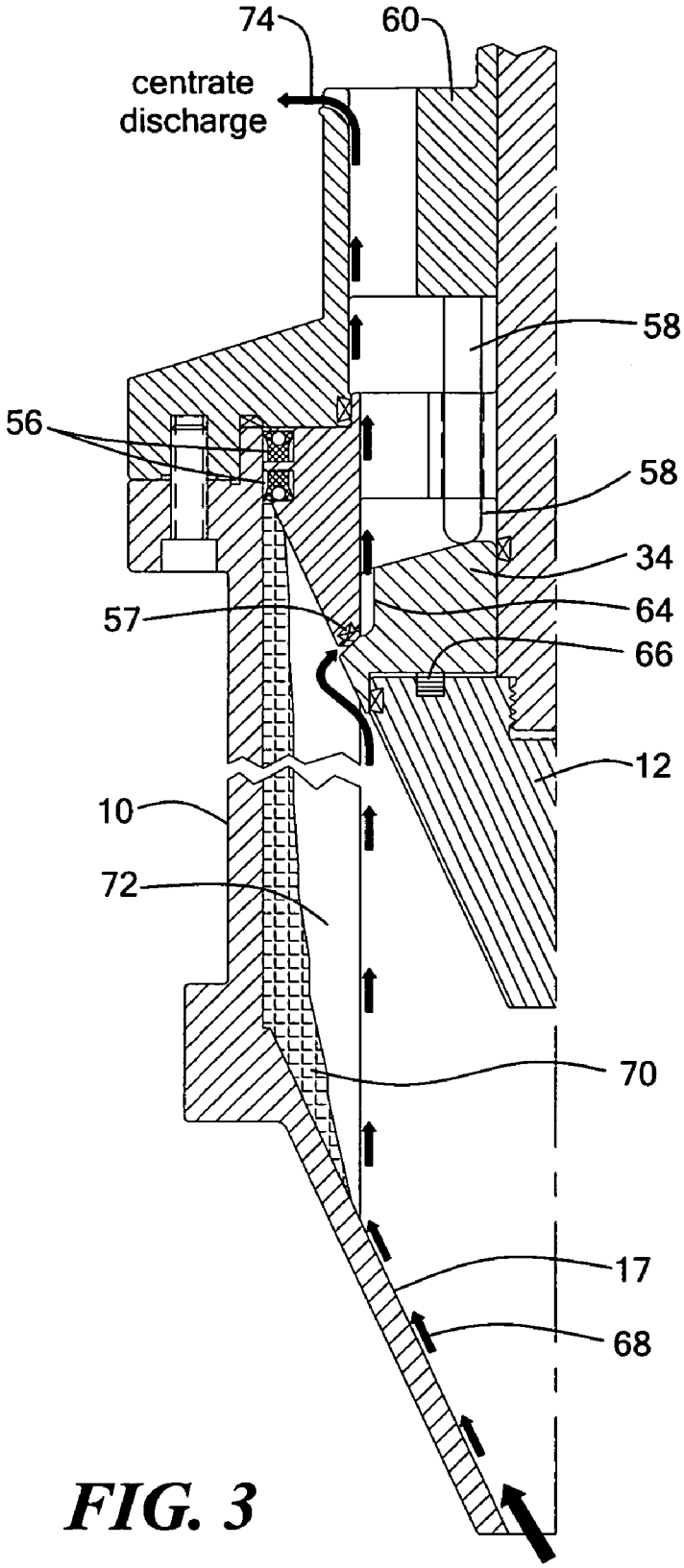
FIG. 3 is a partial section view of a central region of the centrifuge of FIG. 1 illustrating operation in feed mode.

FIG. 3 illustrates operation of the separator during a feed mode of operation, during which the bowl 10 and piston 12 are rotating at high speed. Solids-bearing feed liquid flows in a path 68 up the inner surface of the conical feed cone 17. Under the separation forces generated by high-speed rotation of the bowl 10, the feed liquid is separated into accumulated solids 70 and a relatively solids-free centrate 72. Hydraulic pressure from the centrate 72 holds the piston 12 upward against the hub 60 of the bowl, maintaining the centrate valve 34 in the open position. At the inner surface of the centrate 72, it flows through the grooves 64 of the centrate valve 34 and continues upward along a discharge path until exiting the bowl at a centrate discharge opening 74.

Figure 4:
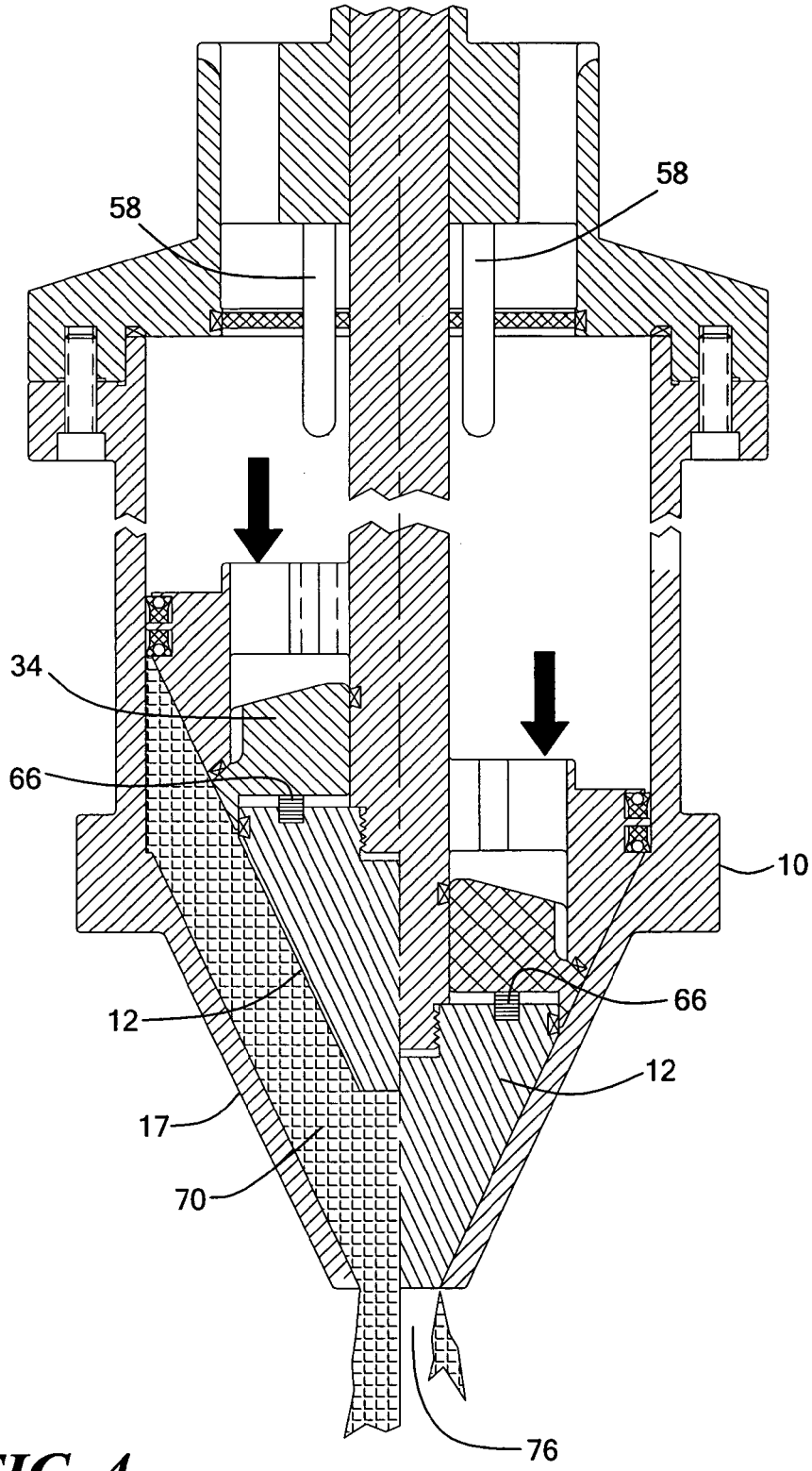
FIG. 4 is a detailed section view of the central region of the centrifuge of FIG. 1 illustrating operation in solids discharge mode.

FIG. 4 illustrates operation of the separator during a solids discharge mode of operation. FIG. 4 is split lengthwise to show two separate positions of the piston 12. On the left, the piston 12 is partway through its downward travel, and on the right, the piston 12 is at its lowermost point at the completion of the discharge operation, with its conical outer surface resting against the inner surface of the conical feed cone 17. It will be observed that the centrate valve 34 is closed, under the upward urging force of the springs 66. As the piston 12 travels downward, the accumulated solids 70 are pressed out of an opening 76 at the bottom of the bowl 10. The conical outer surface of the piston 12 and the inner surface of the conical feed cone 17 are machined for a precise fit, so that the squeezing action of these two surfaces can efficiently remove as much of the solids 70 as possible. Any solids remaining after the discharge process are removed by clean-in-place processes after the piston 12 is returned to its uppermost position by the piston actuator.

Figure 5:
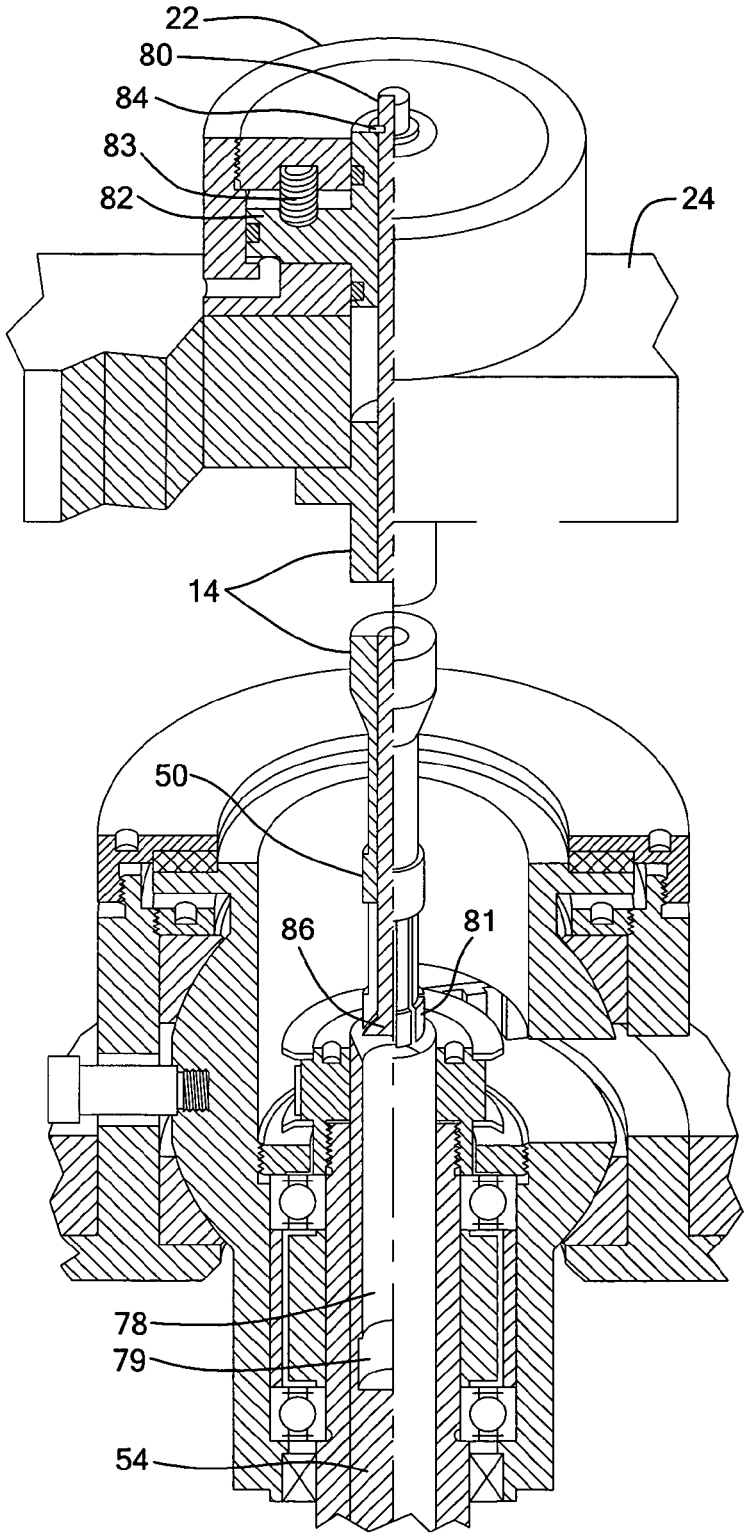
FIG. 5 is a detailed section view of the upper portion of the centrifuge of FIG. 1 when a piston shaft is disconnected to permit rotation of the bowl.
Figure 6:
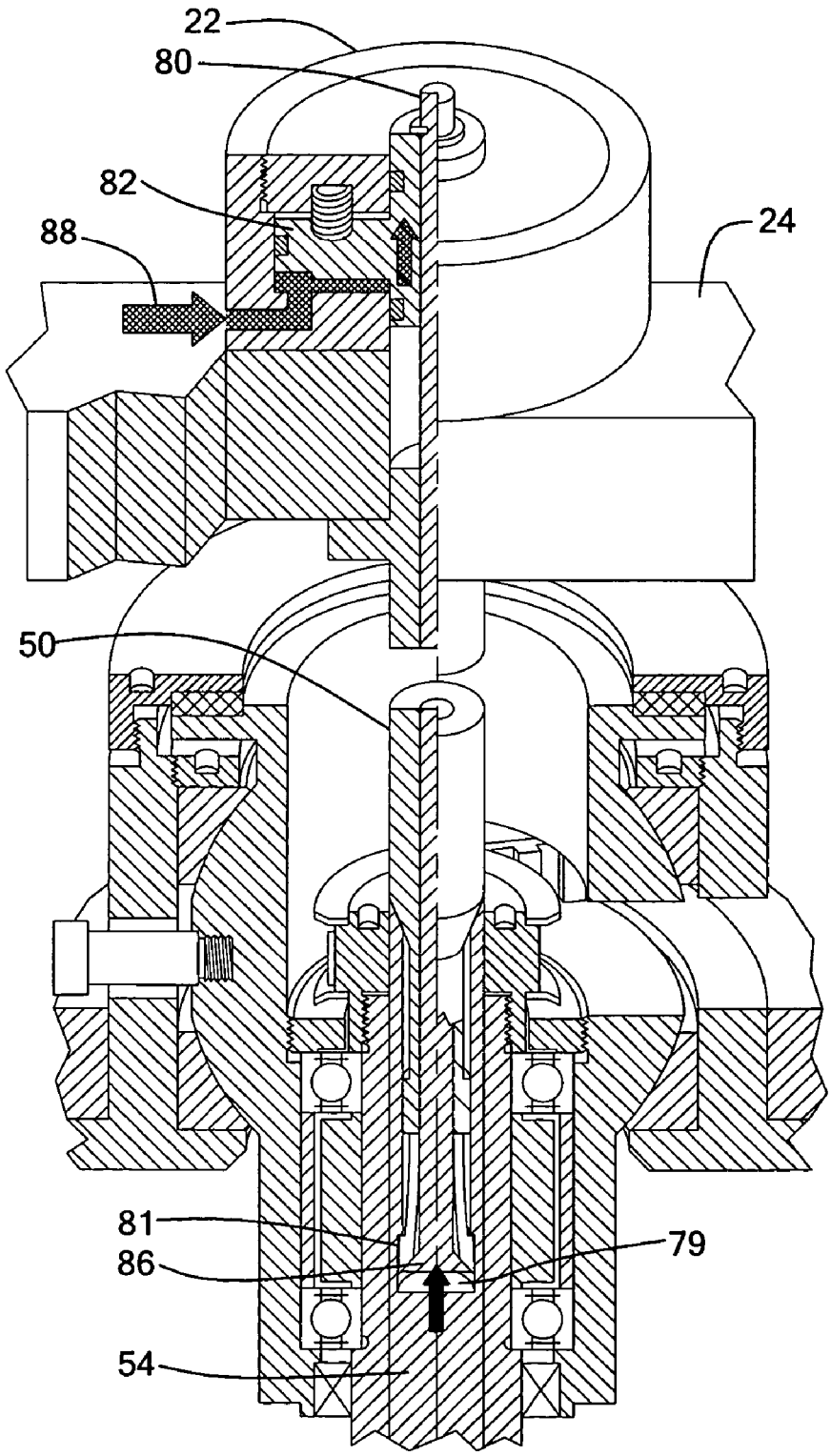
FIG. 6 is a detailed section view of the upper portion of the centrifuge of FIG. 1 when the piston shaft is connected to move a piston axially within the bowl.

FIGS. 5 and 6 illustrate the configuration and operation of the mechanical coupling between the piston 12 and the crosshead 24. The upper piston shaft 50 extends from the underside of the crosshead 24 and moves with it in response to actuation by the piston plungers. FIG. 5 shows the upper piston shaft in a disconnected position in which it is withdrawn from an upper hollow portion 78 of the lower piston shaft 54. It will be observed that the hollow portion 78 includes a slightly wider chamber 79 whose use is explained below. The upper piston shaft 50 is hollow along its entire length, and a coupling lock draw bar 80 is disposed therein. At its lower end, the upper piston shaft 50 includes a plurality of flexible fingers 81 whose function is explained below.

At the upper end, the coupling lock draw bar 80 is mechanically connected to a coupling lock piston 82 located within the coupling lock cylinder 22, such as by a horizontal pin 84 as shown. The coupling lock piston 82 is biased to a downward position by a spring 83. At its lower end 86, the coupling lock draw bar 80 has a flared shape for use in locking the upper and lower piston shafts 50, 54 together as described below.

When the piston shaft is in the disconnected position shown in FIG. 5, the piston 12 is free to move in response to forces other than those generated by the piston actuator. In particular, the piston 12 is held upwardly by hydraulic forces and rotates with the bowl 10 during the feed mode of operation, as described above. It should be noted that at the very beginning of the feed mode of operation, before sufficient hydraulic pressure is present, the piston is held at substantially its uppermost position by frictional forces between the seals 56 and the inner wall of the bowl 10 (FIG. 3). As hydraulic pressure builds, the piston is then pushed upward firmly enough to open the centrate valve 34.

FIG. 6 shows the upper piston shaft in a connected position in which it is inserted into the upper hollow portion 78 (FIG. 5) of the lower piston shaft 54. The insertion typically occurs just prior to the solids discharge operating mode, when the piston 12 is located at its uppermost position within the bowl 10, as the piston actuator lowers the upper piston shaft 50 into the lower piston shaft 54. Then, hydraulic or pneumatic pressure 88 is provided to urge the coupling lock piston 82 upwardly, which in turn urges the coupling lock draw bar 80 upwardly with respect to the upper piston shaft 50. The flanged lower portion 86 of the coupling lock draw bar 80 pushes against the fingers 81 and urges them against the walls of the chamber 79, locking the upper and lower piston shafts 50, 54 together. In this connected configuration, the axial forces generated by the piston actuator cause the piston 12 to move axially. The connected configuration is maintained throughout the solids discharge mode of operation in which the piston 12 is moved downwardly to discharge the accumulated solids. The piston 12 is drawn to its uppermost position when the discharging of solids is complete, and the upper piston shaft 50 is then disconnected from the lower piston shaft 54 in preparation for the next cycle of feed mode operation. As mentioned above, the piston 12 remains in this position due to the frictional forces between the seals 56 and the inner wall of the bowl 10 (FIG. 3).

Figure 7:
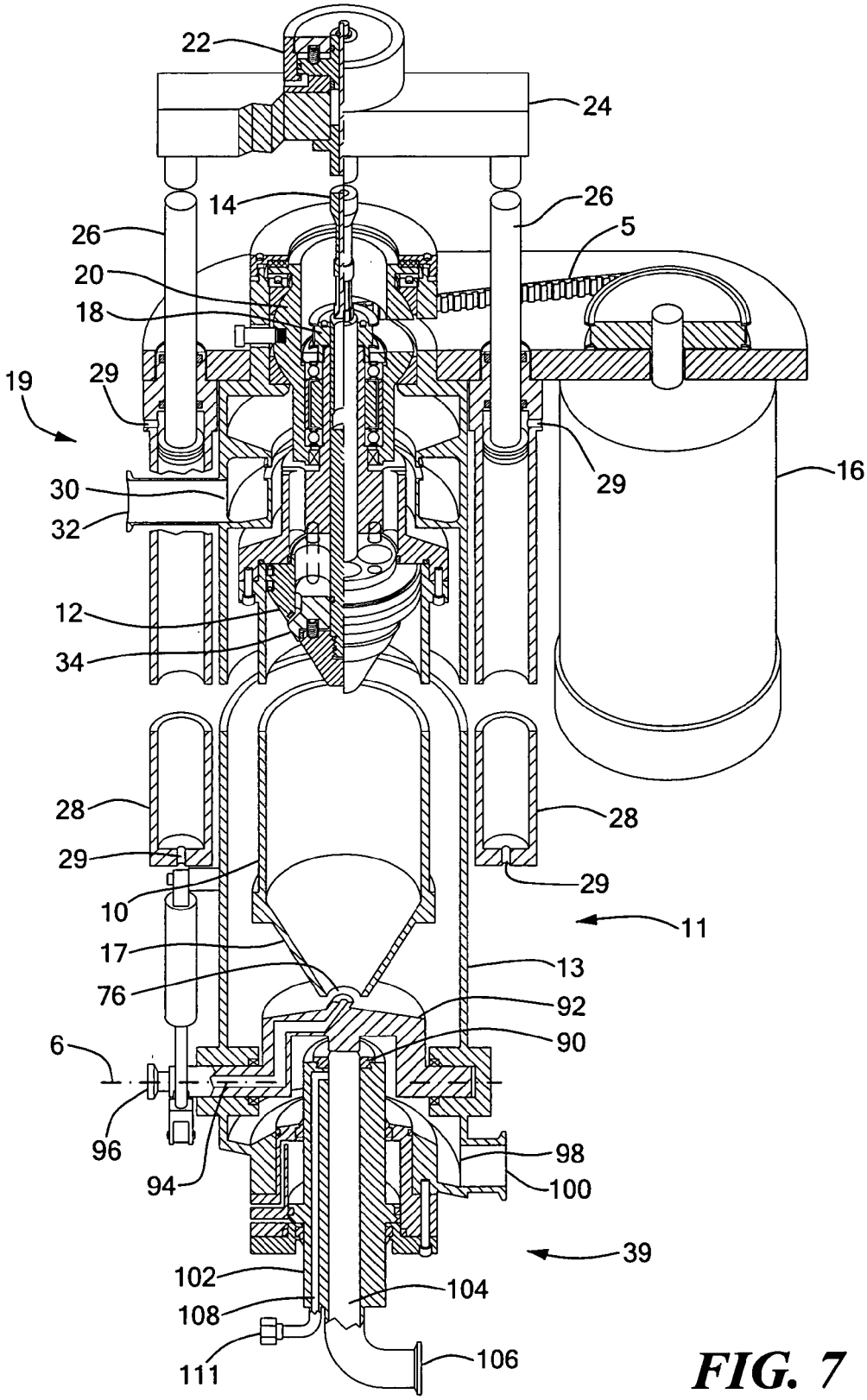
FIG. 7 is a section view of a second embodiment of the centrifuge in accordance with the present invention.

FIG. 7 illustrates another embodiment of the separator in vertical section, with a middle portion removed like FIG. 1 so as to illustrate a horizontal section. In this embodiment, a solids divert valve 90 is movably located in the lower end region 39 of the separator housing 13, below a lower surface of a rotatable residual divert valve 92. The lower surface of the residual divert valve can have a feature that extends partially within the solids divert valve 90. The residual divert valve located at the opening 76 in the bottom of the bowl 10 is shown in a closed position, which is maintained during the feed mode. When closed, the valve 92 defines the feed liquid passage 94 in communication with the feed liquid port 96, as well as the residual drain passage 98 in communication with the residual liquid drain port 100. The valve 92 can be rotated from its closed position about axis 6 such that the solids divert valve 90 can be urged upward into communication with the opening 76 to the bowl, as described below for operation in a solids pumping mode. As shown, the lower end region 39 generally characterizes this embodiment with the central region 11 and the upper portion 19 of the separator being similar to the embodiment described above (FIGS. 1-6).

Also shown in FIG. 7 is a solids passage 104 disposed axially within a solids divert piston 102 and extending beyond the piston 102 at a lowermost end to incorporate a solids outlet port 106. The passage, piston and port 104, 102, 106 are each involved in removing the solids from the centrifugal separator during the solids pumping mode. The solids pumping mode recovers sensitive solids, such as, for example, intact cells, and can pass these solids onto another process or a storage vessel without further handling. Without the solids being handled by an operator, they are less likely to be damaged. A cleaning passage 108 is also disposed within the solids divert piston 102 parallel to the solids passage 104, extending beyond the piston at a lowermost end to incorporate a cleaning port 111. At an uppermost end, the cleaning passage 108 is in communication with the solids passage 104. The cleaning passage and port 108, 111 together aid in the recovery of any solids remaining in the passage 104 following the solids pumping mode, as well as in cleaning or sterilizing the separator.

Figure 8:
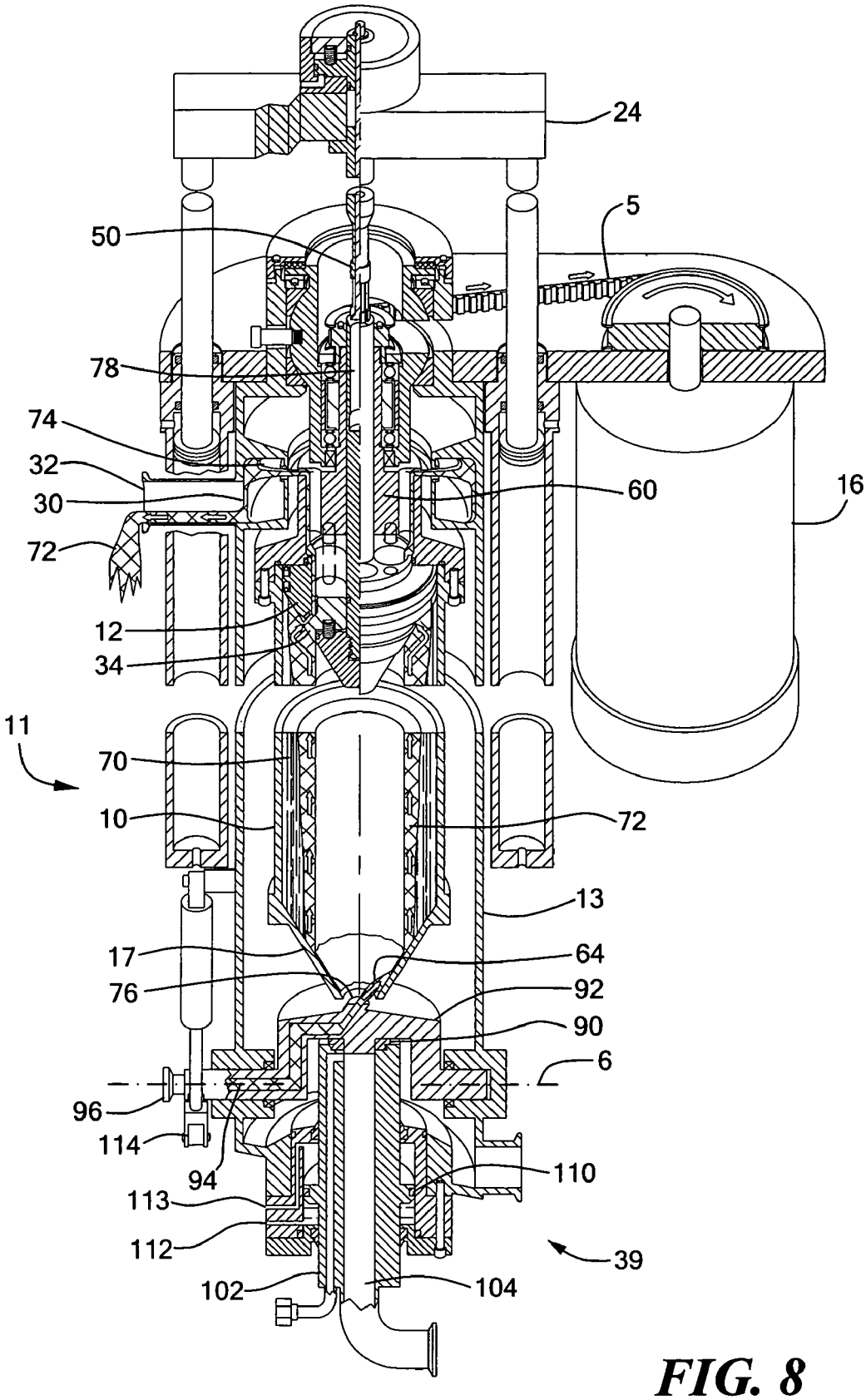
FIG. 8 is a section view of the centrifuge of FIG. 7 illustrating operation in feed mode.

FIG. 8 illustrates the present embodiment during the feed mode of operation, during which the bowl 10 and the piston 12 are rotating together at high speed. As shown, the feed mode is generally similar to that described in the previous embodiment (FIG. 3), wherein the solids-bearing feed liquid is injected into the bowl and flows in a path 64 up the inner surface of the conical feed cone 17. The upper piston shaft 50 is in a disconnected position in which it is withdrawn from the upper hollow portion 78. The piston is held at its uppermost position by hydraulic pressure from the centrate such that the piston is urged against the hub 60 of the bowl, maintaining the centrate valve 34 in the open position. Under the separation forces generated by high-speed rotation of the bowl, the feed liquid is separated into accumulated solids 70 and the relatively solids-free centrate 72. The centrate continues upward along the discharge path, through the centrate valve 34 and exits the bowl at the centrate discharge opening 74. The discharge opening 74 leads into the centrate case 30 and the outlet port 32, where the centrate eventually exits the separator.

During the feed mode, the solids divert valve 90 is held upwardly against a lower surface of the residual divert valve 92 in gas-tight agreement. Seals made of TEFLON-containing (E. I. du Pont de Nemours and Company, 1007 Market Street, Wilmington, Del. 19898) elastomeric materials can be disposed on the divert valves 90, 92 to seal the interface between them. The solids divert valve is urged upward by the solids divert piston 102 on which the valve 90 is disposed at an uppermost end in communication with the solids passage 104 of the piston 102. As shown, compressed air or hydraulic fluid introduced at an actuator port 112 acts on a lower surface of an annular flange 110 disposed about the divert piston to urge the piston upward. The divert piston 102 moves axially upward and downward in response to pneumatic or hydraulic pressure. A control port 113 may also be provided in the lower end region 39 of the separator to aid the actuator port in its movement of the divert piston.

Also shown in FIG. 8 is the residual divert valve 92 in a closed position located at the opening 76 in the bottom of the bowl 10. The valve 92 defines the feed liquid passage 94 in communication with the feed liquid port 96 such that the feed liquid can be injected into the bowl along the path 64. Operatively coupled to the valve 92 is a residual divert valve actuator 114. The actuator, which can be a hydraulic or pneumatic cylinder, rotates the valve 92 from its closed position about axis 6.

Figure 9:
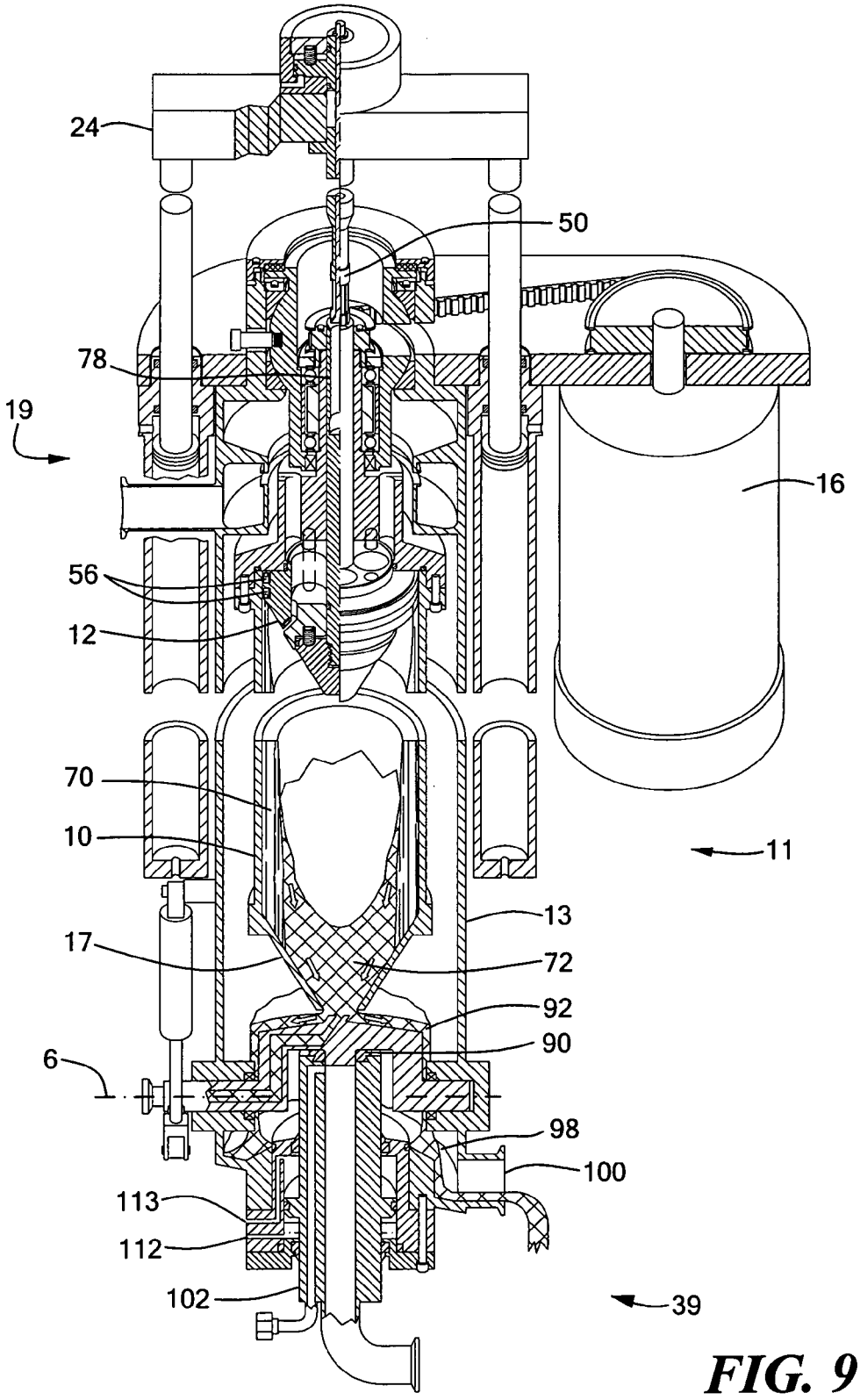
FIG. 9 is a section view of the centrifuge of FIG. 7 illustrating operation when centrate drains from the bowl.

FIG. 9 illustrates the separator with the residual divert valve 92 closed to permit the centrate 72 to drain out of the bowl 10 and into the residual liquid drain passage 98. The drain passage 98 leads into the residual liquid drain port 100, where the centrate eventually drains from the separator. In both embodiments of the separator, the centrate 72 is typically drained from the separator by gravity after the feed mode is completed and the high-speed rotational separation is performed. Although the bowl 10 and the piston 12 are no longer rotating, accumulated solids 70 remain compressed tightly against the inner surface of the bowl. As shown, the upper piston shaft 50 is in a disconnected position in which it is withdrawn from the upper hollow portion 78. The piston 12 is held substantially at its uppermost position by frictional forces between the seals 56 and the inner wall of the bowl (FIG. 3). Each of the separator embodiments may allow centrate to drain from the bowl and could be performed, for example, by the configuration shown in FIG. 9.

Figure 10:
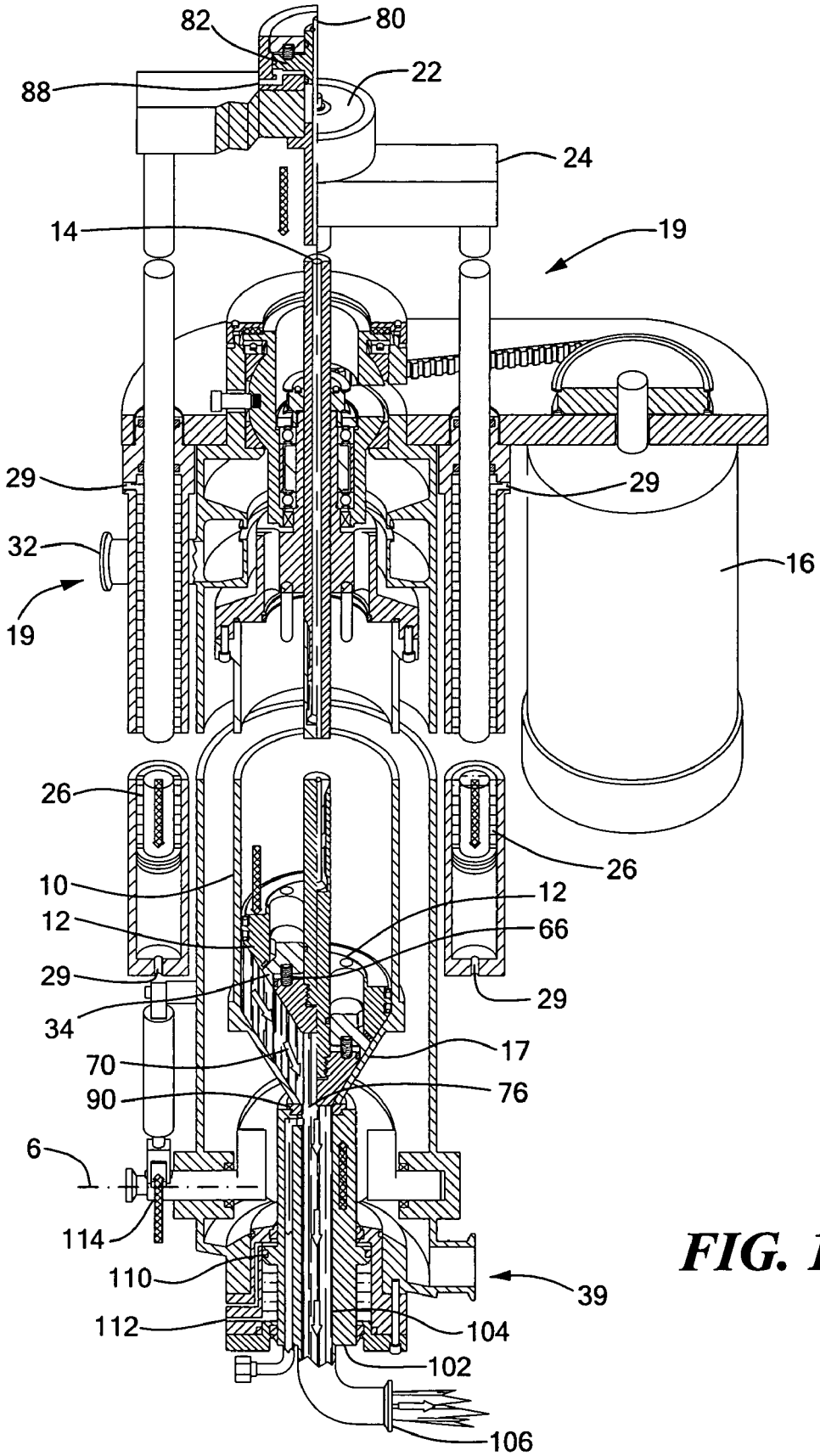
FIG. 10 is a section view of the centrifuge of FIG. 7 illustrating operation in pumping mode.

After solids separation and the residual centrate 72 has drained from the bowl 10, the residual divert valve 92 is rotated and opened to enable the pumping of the accumulated solids 70 from the separator. FIG. 10 illustrates the present embodiment of the separator operating in the solids pumping mode. FIG. 10 is split lengthwise like FIG. 4 to show two separate positions of the piston 12. On the left, the piston is partway through its downward travel, and on the right, the piston is at its lowermost point at the completion of the pumping operation, with its conical outer surface resting against the inner surface of the conical feed cone 17. As shown, the centrate valve 34 is closed, under the upward urging force of the springs 66 and by the interaction between the accumulated solids and the conical outer surface of the piston 12 during its downward travel. With the piston 12 traveling downward, the accumulated solids 70 are pressed out of the opening 76 at the bottom of the bowl 10. Similar to the embodiment described above, the conical outer surface of the piston and the inner surface of the conical feed cone are machined for precise fit to efficiently remove as much of the accumulated solids from the bowl as possible.

Also shown in FIG. 10 is the piston shaft coupling lock cylinder 22 mounted in the crosshead 24 of the piston actuator with its actuator plungers 26. As described above, the actuator plungers 26 are operatively connected to the piston shaft 14 via the crosshead for axially pulling or pushing the piston 12 within the bowl 10 in response to compressed air or hydraulic pressure introduced at the piston actuator ports 29. Although not shown, the upper piston shaft 50 is inserted into the upper hollow portion 78 of the lower piston shaft 54 (FIG. 6) before the solids pumping mode begins, and when the piston is located at its uppermost position within the bowl 10. Pneumatic or hydraulic pressure 88 is then introduced to urge the coupling lock piston 82 upward, which in turn urges the coupling lock draw bar 80 upward with respect to the upper piston shaft. The flanged lower portion 86 of the coupling lock draw bar 80 pushes against the fingers 81 and urges them against the walls of the chamber 79, locking the upper and lower piston shafts 50, 54 together (FIG. 6). When connected, the actuator plungers 26 can push or pull the piston within the bowl. The solids pumping mode begins in the upper portion 19 of the separator by the piston moving axially downward to push the accumulated solids 70 from the bowl.

At the lower end region 39 of the separator, the solids pumping mode begins with the solids divert piston 102 being lowered by reduction of the compressed air or hydraulic fluid pressure previously applied at actuator port 112. The residual divert valve 92 is then rotated from its closed position by the residual divert valve actuator 114. The valve actuator 114 rotates the residual divert valve about axis 6 in response to pneumatic or hydraulic pressure. The residual divert valve is preferably rotated 90° from its closed position. The solids divert valve 90 can then be urged upward by the solids divert piston 102. As shown, compressed air or hydraulic fluid introduced at the actuator port 112 acts on the annular flange 110 of the piston 112 to urge it axially upward such that the solids divert valve is held in gas-tight communication with the opening 76 at the bottom of the bowl 10. The interface of the valve 90 and the bowl opening 76 can also be sealed by TEFLON-containing (E. I. du Pont de Nemours and Company, 1007 Market Street, Wilmington, Del. 19898) elastomeric seals disposed therebetween such that the pumped solids cannot be contaminated.

Operating the separator in the solids pumping mode is generally similar to the discharge mode described above (FIG. 4). Although in the present embodiment, solids pushed through the opening 76 in the bottom of the bowl 10 pass into the solids passage 104 disposed partially within the solids divert piston 102 below the solids divert valve 90. The solids passage 104 extends beyond the lowermost end of piston 102 leading into the solids outlet port 106, where the pumped solids eventually exit and are recovered from the separator. The outlet port 106 can pass the pumped solids onto another process or a storage vessel without further handling by an operator or the opportunity for contamination.

As described, the solids pumping mode of operation is completed as the piston 12 reaches the lowermost point of its downward stroke and rests against the inner surface of the conical feed cone 17. The piston is returned to its uppermost position by actuation of the piston plungers 29, when the pumping of solids is complete. The solids divert valve 90 is also drawn downward by movement of the solids divert piston 102 such that the residual divert valve 92 can be rotated to its closed position about rotational axis 6 in response to compressed air or hydraulic fluid acting on the residual divert valve actuator 114. The solids divert valve 90 is then urged upward against the lower surface of the residual divert valve 92. At the upper portion 19 of the separator, the upper piston shaft 50 is then disconnected from the lower piston shaft 54 in preparation for the next cycle of feed mode operation (FIG. 5).

Figure 11:
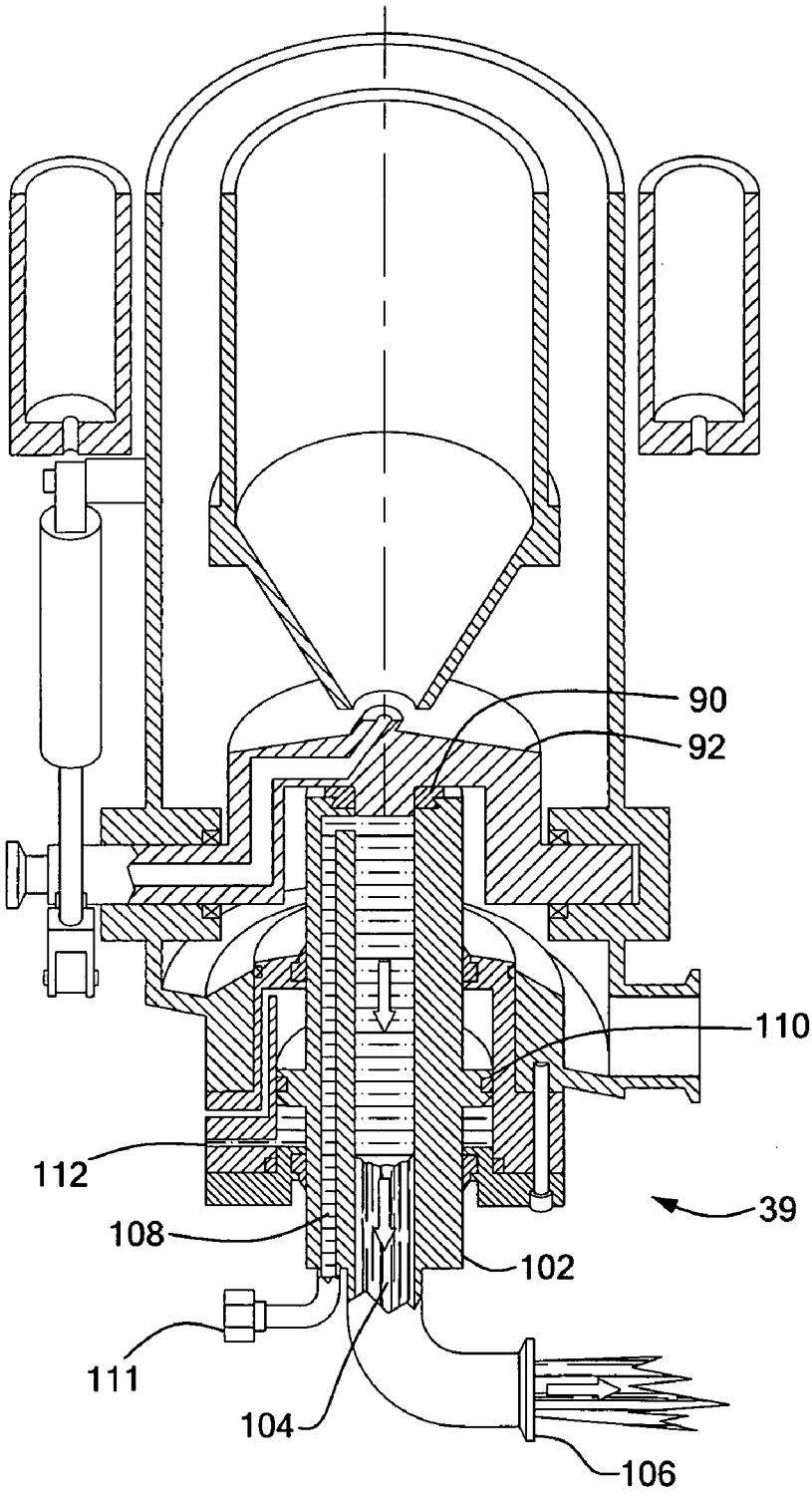
FIG. 11 is a detailed section view of a lower end region of the centrifuge of FIG. 7 when a solids passage is cleaned.

FIG. 11 illustrates the lower end region of the separator in greater detail with the residual divert valve 92 returned to its closed position. The solids divert valve 90 is held upward against the lower surface of the residual divert valve by the solids divert piston 102. As shown, compressed air or hydraulic fluid introduced at an actuator port 112 acts on a lower surface of an annular flange 110 disposed about the divert piston to urge it upward. Although the solids pumping mode is completed, solids can remain in the solids passage 104 of the piston 102. To remove the remaining solids, compressed air or hydraulic fluid is introduced to the cleaning port 111 of the cleaning passage 108.

The cleaning passage and port 108, 111 extend beyond the lowermost end of the piston 102, with the cleaning passage partially disposed within the piston. The cleaning passage is also in communication at its uppermost end with the solids passage 104 of the piston 102. This communication permits compressed air or hydraulic fluid introduced at the cleaning port to pass through the cleaning passage 108 and into the solids passage 104. The compressed air or hydraulic fluid pushes the remaining solids in the passage 104 toward the solids outlet port 106. As shown, the solids passage 104 is in communication with the outlet port 106 such that any remaining solids in the passage can exit the separator. The outlet port 106 can pass the recovered solids onto another process or a storage vessel without further handling.

The cleaning passage and port 108, 111 can also be used to clean or sterilize the solids passage 104 and outlet port 106. In both embodiments of the separator, such clean-in-place or sterilize-in-place processes are convenient for preparing the centrifugal separator for the next cycle of operation and may be performed, for example, by the configuration shown in FIG. 11. These processes also reduce the likelihood of operator contamination.

While the present invention has been described in conjunction with a preferred embodiment, one of ordinary skill in the art, after reading the foregoing specification, will be able to effect various changes, substitutions of equivalents and other alterations to the compositions, articles, methods and apparatuses set forth herein. Furthermore, the embodiments described above may each include or incorporate any of the variations of all other embodiments. It is therefore intended that the protection granted by Letter Patent hereon be limited only by the definitions contained in the appended claims and equivalents thereof.

What is claimed is:

1. A divert assembly for a centrifugal separator, comprising:

a first valve member proximate to an opening of a separator bowl, the first valve member operatively coupleable to a valve actuator for rotating the first valve member about a rotational axis;

a second valve member cooperating with a lower surface of the first valve member when the first valve member is in a closed position; and a valve piston having an uppermost end at which the second valve member is proximately disposed, the valve piston operative to move the second valve member with respect to the bowl.

2. The divert assembly for a centrifugal separator of claim 1, wherein during a solids pumping mode of operation the valve piston moves the second valve member upward along a vertical axis to cooperate with the opening in the bowl.

3. The divert assembly for a centrifugal separator of claim 1, wherein during a feed mode of operation the first valve member is in the closed position permitting feed liquid to be injected into the bowl.

4. The divert assembly for a centrifugal separator of claim 3, wherein the first valve member defines a feed passage, the feed passage cooperating with the opening in the bowl during the feed mode of operation to permit feed liquid to be injected into the bowl.

5. The divert assembly for a centrifugal separator of claim 1, wherein the first valve member defines a drain passage, the drain passage operative to permit centrate to drain from the opening in the bowl when the first valve member is in the closed position.

6. The divert assembly for a centrifugal separator of claim 5, wherein the opening in the bowl and the drain passage are configurable to enable centrate to drain by gravity from the bowl into the drain passage.

7. The divert assembly for a centrifugal separator of claim 1, wherein a first passage is partially disposed within the valve piston, the first passage cooperating with the second valve member at the uppermost end of the valve piston.

8. The divert assembly for a centrifugal separator of claim 7, wherein the first passage extends beyond a lowermost end of the valve piston.

9. The divert assembly for a centrifugal separator of claim 7, wherein the opening in the bowl and the first passage are configurable to enable solids from the bowl to pass through the first passage during a solids pumping mode of operation.

10. The divert assembly for a centrifugal separator of claim 7, wherein the first passage cooperates with a second passage partially disposed within the valve piston.

11. The divert assembly for a centrifugal separator of claim 10, wherein the second passage extends beyond a lowermost end of the valve piston.

12. The divert assembly for a centrifugal separator of claim 11, wherein compressed air or hydraulic fluid introduced through a port for the second passage enters the first passage to contact solids therein.

13. The divert assembly for a centrifugal separator of claim 1, wherein an annular flange is disposed about the valve piston.

14. The divert assembly for a centrifugal separator of claim 13, wherein the valve piston moves in response to compressed air or hydraulic fluid contacting the annular flange.

15. A divert assembly for a centrifugal separator, comprising:

a first valve assembly, wherein the first valve assembly comprises a first valve member, the first valve member proximate to an opening of a separator bowl, and an actuator operatively coupleable to the first valve member for rotating the first valve member about a rotational axis; and a second valve assembly, wherein the second valve assembly comprises a second valve member, the second valve member cooperating with the first valve member of the first valve assembly when the first valve member is in a closed position, and a valve piston, the valve piston having an uppermost end at which the second valve member is proximately disposed, wherein the valve piston is operative to move the second valve member with respect to the bowl.

16. The divert assembly for a centrifugal separator of claim 15, wherein during a solids pumping mode of operation the valve piston moves the second valve member upward along a vertical axis to cooperate with the opening in the bowl.

17. The divert assembly for a centrifugal separator of claim 15, wherein during a feed mode of operation the first valve member is in the closed position permitting feed liquid to be injected into the bowl.

18. The divert assembly for a centrifugal separator of claim 17, wherein the first valve member defines a feed passage, the feed passage cooperating with the opening in the bowl during the feed mode of operation to permit feed liquid to be injected into the bowl.

19. The divert assembly for a centrifugal separator of claim 15, wherein the first valve member defines a drain passage, the drain passage operative to permit centrate to drain from the opening in the bowl when the first valve member is in the closed position.

20. The divert assembly for a centrifugal separator of claim 19, wherein the opening in the bowl and the drain passage are configurable to enable centrate to drain by gravity from the bowl into the drain passage.

21. The divert assembly for a centrifugal separator of claim 15, wherein a first passage is partially disposed within the valve piston, the first passage cooperating with the second valve member at the uppermost end of the valve piston.

22. The divert assembly for a centrifugal separator of claim 21, wherein the first passage extends beyond a lowermost end of the valve piston.

23. The divert assembly for a centrifugal separator of claim 21, wherein the opening in the bowl and the first passage are configurable to enable solids from the bowl to pass through the first passage during a solids pumping mode of operation.

24. The divert assembly for a centrifugal separator of claim 21, wherein the first passage cooperates with a second passage partially disposed within the valve piston.

25. The divert assembly for a centrifugal separator of claim 24, wherein the second passage extends beyond a lowermost end of the valve piston.

26. The divert assembly for a centrifugal separator of claim 25, wherein compressed air or hydraulic fluid introduced through a port for the second passage enters the first passage to contact solids therein.

27. The divert assembly for a centrifugal separator of claim 15, wherein an annular flange is disposed about the valve piston.

28. The divert assembly for a centrifugal separator of claim 27, wherein the valve piston moves in response to compressed air or hydraulic fluid contacting the annular flange.

29. A centrifugal separator, comprising:

a cylindrical bowl having a frustoconical lower end with an opening, the bowl being operative during a feed mode of operation to rotate at a high speed to separate the feed liquid into centrate and solids, the solids accumulating along an inner surface of the bowl;

a piston assembly including a conical piston coupled to a piston actuator, the piston being movably disposed against the inner surface of the bowl, the piston actuator operative to move the piston along a vertical axis to force accumulated solids from the opening in the bowl; and a first valve member, wherein the first valve member defines a drain passage, the drain passage operative to permit centrate to drain from the opening in the bowl when the first valve member is in the closed position.

30. The centrifugal separator of claim 29, wherein the opening in the bowl and the drain passage are configurable to enable centrate to drain by gravity from the bowl into the drain passage.

31. The centrifugal separator of claim 29, wherein the first valve member defines a feed passage, the feed passage cooperating with the opening in the bowl during the feed mode of operation to permit feed liquid to be injected into the bowl.

32. The centrifugal separator of claim 29, wherein the first valve member is operatively coupleable to a valve actuator for rotating the first valve member about a rotational axis.

33. A centrifugal separator, comprising:

a cylindrical bowl having a frustoconical lower end with an opening, the bowl being operative during a feed mode of operation to rotate at a high speed to separate the feed liquid into centrate and solids, the solids accumulating along an inner surface of the bowl;

a piston assembly including a conical piston coupled to a piston actuator, the piston being movably disposed against the inner surface of the bowl, the piston actuator operative to move the piston along a vertical axis to force accumulated solids from the opening in the bowl;

a first valve assembly, wherein the first valve assembly comprises a first valve member, the first valve member proximate to an opening of a separator bowl, and an actuator operatively coupleable to the first valve member for rotating the first valve member about a rotational axis; and a second valve assembly, wherein the second valve assembly comprises a second valve member, the second valve member cooperating with the first valve member of the first valve assembly when the first valve member is in a closed position, and a valve piston, the valve piston having an uppermost end at which the second valve member is proximately disposed, wherein the valve piston is operative to move the second valve member with respect to the bowl.

34. The centrifugal separator of claim 33, wherein during a solids pumping mode of operation the valve piston moves the second valve member upward along a vertical axis to cooperate with the opening in the bowl.

35. The centrifugal separator of claim 34, wherein the conical piston includes a centrate valve having an open position in the feed mode of operation and a closed position in the solids pumping mode of operation, the centrate valve being operative in the open position to permit the flow of the centrate from the bowl into a passage to a centrate discharge port of the separator, the centrate valve being operative in the closed position to block the passage of the accumulated solids from the bowl into the passage to the centrate discharge port.

36. The centrifugal separator of claim 35, wherein the centrate valve is an annular member located at substantially the midsection of the conical piston.

37. The centrifugal separator of claim 35, wherein the conical piston is configured to bias the centrate valve in the closed position, the bowl includes a hub against which the conical piston is located during the feed mode of operation, and the hub and the conical piston are cooperatively configured such that the centrate valve is urged to the open position when the conical piston is located against the hub.

38. The centrifugal separator of claim 37, wherein the conical piston includes one or more springs operative to bias the centrate valve in the closed position.

39. The centrifugal seperator of claim 38, wherein the hub includes one or more downward-extending pins, and the conical piston includes one or more openings through which the pins extend when the conical piston is disposed adjacent the hub, the pins contacting the centrate valve and maintaining it in the open position when the conical piston is located adjacent the hub.

40. The centrifugal separator of claim 33, wherein during a feed mode of operation the first valve member is in the closed position permitting feed liquid to be injected into the bowl.

41. The centrifugal separator of claim 40, wherein the first valve member defines a feed passage, the feed passage cooperating with the opening in the bowl during the feed mode of operation to permit feed liquid to be injected into the bowl.

42. The centrifugal separator of claim 40, wherein the coupling between the conical piston and the piston actuator is operative to permit the piston to be held at an uppermost position in the bowl by hydraulic pressure from the feed liquid in the feed mode of operation.

43. The centrifugal separator of claim 33, wherein the first valve member defines a drain passage, the drain passage operative to permit centrate to drain from the opening in the bowl when the first valve member is in the closed position.

44. The centrifugal separator of claim 43, wherein the opening in the bowl and the drain passage are configurable to enable centrate to drain by gravity from the bowl into the drain passage.

45. The centrifugal separator of claim 33, wherein the coupling between the conical piston and the piston actuator comprises:

a lower piston shaft extending upwardly from the piston and having a hollow upper portion; and a hollow upper piston shaft having first and second positions with respect to the lower piston shaft, the first position being a disconnected position in which the upper piston shaft is withdrawn from the hollow portion of the lower piston shaft, the second position being a connected position in which the upper piston shaft is inserted within the hollow portion of the lower piston shaft and mechanically linked thereto.

46. The centrifugal separator of claim 45, wherein the upper piston shaft including a plurality of flexible, downward-extending fingers that in a relaxed position permit the upper piston shaft to slide with respect to the lower piston shaft.

47. The centrifugal separator of claim 46, wherein a coupling lock draw bar is disposed within the upper piston shaft, the coupling lock draw bar being configured at a lower end thereof to urge the fingers of the upper piston shaft outwardly against the internal wall of the lower piston shaft to lock the upper and lower piston shafts together when the coupling lock draw bar is urged upwardly with respect to the upper piston shaft.

48. The centrifugal separator of claim 47, wherein a mechanism at the upper end of the upper piston shaft is operative to selectively apply an upward force on the coupling lock draw bar with respect to the upper piston shaft to mechanically link the upper and lower piston shafts together.

49. The centrifugal separator of claim 48, wherein the force-applying mechanism comprises a coupling lock cylinder through which the coupling lock draw bar extends, the coupling lock cylinder including an actuatable piston operative in response to an actuating force to apply the upward force to the coupling lock draw bar.

50. The centrifugal separator of claim 49, wherein the actuating force is hydraulic or pneumatic.

* * * * *